US010499467B2

(12) United States Patent
Wang

(10) Patent No.: US 10,499,467 B2
(45) Date of Patent: Dec. 3, 2019

(54) LED LAMP WITH CONSTANT CURRENT DIMMING DRIVE CIRCUIT BASED ON PWM INPUT

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventor: Qiming Wang, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/224,266

(22) Filed: Dec. 18, 2018

(65) Prior Publication Data

US 2019/0191507 A1 Jun. 20, 2019

(30) Foreign Application Priority Data

Dec. 18, 2017 (CN) ..... 2017 1 1361210

(51) Int. Cl.
*H05B 33/08* (2006.01)

(52) U.S. Cl.
CPC ..... *H05B 33/0815* (2013.01); *H05B 33/0845* (2013.01)

(58) Field of Classification Search
None
See application file for complete search history.

(56) References Cited

U.S. PATENT DOCUMENTS

2010/0060181 A1* 3/2010 Choi ..... H05B 33/0809 315/224

* cited by examiner

*Primary Examiner* — Dedei K Hammond
(74) *Attorney, Agent, or Firm* — Wang Law Firm, Inc.

(57) ABSTRACT

An LED lamp with constant current dimming drive circuit based on PWM input includes a PWM variable power supply input end, a PWM matching circuit, a voltage rectifying circuit, a DC-DC constant current output circuit and an LED lamp, and the voltage signal of the PWM variable power supply input end is provided by the PWM voltage output power supply, and the PWM variable power supply input end is respectively connected with the PWM matching circuit and the voltage rectifying circuit, and the PWM matching circuit is connected with the enable end of the DC-DC constant current output circuit, and the voltage rectifying circuit is connected to the power supply end of the DC-DC constant current output circuit, and the voltage of the voltage rectifying circuit changes according to the duty ratio of the voltage of the PWM variable power supply input end, and the voltage of the PWM variable power supply input end passes through the voltage dividing resistor of PWM matching circuit and output PWM control signal, and PWM control signal realizes non-stroboscopic adjustment LED lamp through the DC-DC constant current output circuit.

8 Claims, 5 Drawing Sheets

LED LAMP WITH CONSTANT CURRENT DIMMING DRIVE CIRCUIT BASED ON PWM INPUT

CROSS-REFERENCE TO A RELATED APPLICATION

This application claims priority to a Chinese Patent Application No. CN 201711361210.3, filed on Dec. 18, 2017.

FIELD OF THE TECHNOLOGY

The present invention relates to LED control field, with particular emphasis on a LED lamp with constant current dimming drive circuit based on PWM input.

BACKGROUND

At present, LED is widely used in different lighting fields as an important lighting device. Wth the increasing requirements for light color accuracy and light quality (such as stroboscopic), the dimming characteristics of LEDs have become a basic requirement for LED lighting products.

Faced with these demands, the current industry mainly adopts PWM (Pulse Width Modulation) dimming (frequency modulation method). The advantage of this dimming method is that the color control is relatively accurate, the color algorithm is relatively simple, and the disadvantage is that it is in low brightness or the duty ratio of a light supply is very small and is prone to stroboscopic phenomena.

At present, the practice of intelligent dimming usually adopts wireless transmission and reception; The received signal is processed by MCU and output PWM control signal to the dimmer end of LED drive IC, so that the current output from the driver IC to the LED is also the PWM current, since the PWM signal is the duty cycle signal, which causes the LED to easily strobe, the smaller the duty cycle, the more severe the strobe of the LED lamp.

Most of the current front and back phase-shift dimming LED power supplies in the existing market are constant current output, which can be adjusted by directly connecting LED lights. The lamp line is simple and lighting circuit and the cost is low, which is only for one lamp. If the large area is multi-lighting, a lot of LED power supply should be used to match the lamps. In this way, the overall cost is not low. The main problem is that it is difficult to purchase LED lamps and the penetration rate is low, the installation personnel must have certain professional knowledge.

Another type of front-back phase-shifting dimming LED power supply is PWM constant voltage output, It can be adjusted according to the duty ratio of PWM, but this dimming mode LED lamp is high-frequency flashing (between 100 Hz and 10 kHz). If the PWM frequency is low, the flashing of the light is easily captured by the mobile phone. A higher frequency LED power supply will also be captured by the mobile phone, but the effect is smaller and the effect is slightly better. Such LED flashing will affect the human eye, which is not good for vision. Striping interference will appear in the image when taking pictures or recording with a mobile phone, which is not an ideal lighting fixture.

SUMMARY OF THE INVENTION

Therefore, the present invention provides a In order to solve the PWM constant voltage output, the LED lamp connected to the front and rear phase shifting dimming LED power supply can be flicker-free, that is, the LED lamp which has both constant voltage dimming and no stroboscopic light, and the present invention provides a LED lamp with constant current dimming drive circuit based on PWM input to solve the above problems.

The invention is realized according to the following technical scheme:

An LED lamp with constant current dimming drive circuit based on PWM input, characterized in that: comprises a PWM variable power supply input end, a PWM matching circuit, a voltage rectifying circuit, a DC-DC constant current output circuit, and an LED lamp, wherein the voltage signal of the PWM variable power supply input end is provided by a PWM voltage output power supply, and the PWM variable power supply input end is respectively connected to the PWM matching circuit and the voltage rectifying circuit, the PWM matching circuit is connected to the enable end of the DC-DC constant current output circuit, and the voltage rectifying circuit is connected to the power supply end of the DC-DC constant current output circuit for supplying power to the DC-DC constant current output circuit, wherein the voltage of the voltage rectifying circuit changes in accordance with a duty cycle of a voltage of the PWM variable power supply input end, the PWM matching circuit including at least two voltage dividing resistors, and a voltage of the PWM variable power supply input is divided by the voltage dividing resistor of PWM matching circuit; wherein the PWM matching circuit outputs a PWM control signal, and the PWM control signal provides a non-stroboscopic adjustment to the LED lamp through the DC-DC constant current output circuit.

Advantageously, the voltage rectifying circuit includes a resistor R3, an electrolytic capacitor C1, and a diode D1, the anode of the diode D1 is connected to the PWM variable power supply input end, and the resistor R3 is connected in parallel with the electrolytic capacitor C1, the cathode of the diode D1 is connected to the power supply end of the DC-DC constant current output circuit and the anode of the electrolytic capacitor C1, and the cathode of the electrolytic capacitor is grounded.

Advantageously, the PWM matching circuit includes a voltage dividing resistor R1 and a voltage dividing resistor R2, one end of the voltage dividing resistor R1 is connected to the PWM variable power supply input end, and the other end of the voltage dividing resistor R1 is respectively connected to the enable end of the DC-DC constant current output circuit and one end of the voltage dividing resistor R2, and the other end of the voltage dividing resistor R2 is grounded.

Advantageously, the diode D1 is used for isolating the electrolytic capacitor C1 and the PWM variable power supply input end, when the voltage value of the PWM variable power supply input end is greater than the electrolytic voltage of the electrolytic capacitor C1, the diode D1 is turned on and charges the electrolytic capacitor C1, and simultaneously supplies power to the DC-DC constant current output circuit; when the voltage value of the PWM variable power supply input end is lower than the electrolytic voltage of the electrolytic capacitor C1, the diode D1 is turned off, and the electrolytic capacitor C1 supplies power to the DC-DC constant current output circuit.

An LED lamp with constant current dimming drive circuit based on PWM input, characterized in that: comprises a PWM variable power supply input end, a DC voltage control circuit, a voltage rectifying circuit, a DC-DC constant current output circuit, and an LED lamp, wherein the voltage signal of the PWM variable power supply input end is provided by a PWM voltage output power supply, and the PWM variable power supply input end is respectively connected to the DC voltage control circuit and the voltage rectifying circuit, and the DC voltage control circuit is connected to the enable end of the DC-DC constant current output circuit, and the voltage rectifying circuit is connected to the power supply end of the DC-DC constant current output circuit for supplying power to the DC-DC constant current output circuit, the voltage of the voltage rectifying circuit changes in accordance with a change in duty cycle of the voltage at the PWM variable power supply input end, the DC voltage control circuit comprising at least two voltage dividing resistors and at least two capacitors, the voltage of the PWM variable power supply input end outputs a DC voltage control signal through the DC voltage control circuit, and the DC voltage control signal provides a non-stroboscopic adjustment to the LED lamp through the DC-DC constant current output circuit.

Advantageously, the voltage rectifying circuit includes a resistor R8, an electrolytic capacitor C5, and a diode D5, the anode of the diode D5 is connected to the PWM variable power supply input end, and the resistor R8 is connected in parallel with the electrolytic capacitor C5, the cathode of the diode D5 is connected to the power supply end of the DC-DC constant current output circuit and the anode of the electrolytic capacitor C5, and the cathode of the electrolytic capacitor is grounded.

Advantageously, the diode D5 is used for isolating the electrolytic capacitor C5 and the PWM variable power supply input end, when the voltage value of the PWM variable power supply input end is greater than the electrolytic voltage of the electrolytic capacitor C5, the diode D5 is turned on and charged to the electrolytic capacitor C5, and simultaneously supplying power to the DC-DC constant current output circuit; when the voltage value of the PWM variable power supply input end is lower than the electrolytic voltage of the electrolytic capacitor C5, the diode D5 is turned off, and the electrolytic capacitor C5 supplies power to the DC-DC constant current output circuit.

Advantageously, the DC voltage control circuit includes a voltage dividing resistor R6, a voltage dividing resistor R7, a voltage dividing resistor R9, a capacitor C6, and a capacitor C7, one end of the voltage dividing resistor R6 is connected to the PWM variable power supply input end, and the other end of the voltage dividing resistor R6 is connected to one end of the capacitor C6 and the voltage dividing resistor R7, and the other end of the capacitor C6 is grounded, the other end of the voltage dividing resistor R7 is respectively connected to the enable end of the DC-DC constant current output circuit and the capacitor C7, one end of the voltage dividing resistor R9, the other end of the capacitor C7 is grounded, and the other end of the voltage dividing resistor R9 is grounded.

Compared with the existing technology, the invention has the following technical effect:

The invention not only retains all advantages of front and back phase-shift dimming LED power supply with PWM constant voltage output, also can solve the lamp stroboscopic problem, adjustable brightness uniformity is good, the dimming deviation between LED lamps is small, and the drive circuit of the present invention makes the LED lamp is suitable for installation of large area, easy installation, high reliability, simple and convenient control. The LED lamp's lamp current is proportional to the duty ratio of PWM to facilitate the mass parallel of such lamps.

DETAILED DESCRIPTION OF THE DRAWINGS

The drawings described herein are intended to promote a further understanding of the present invention, as follows.

Figure 4:
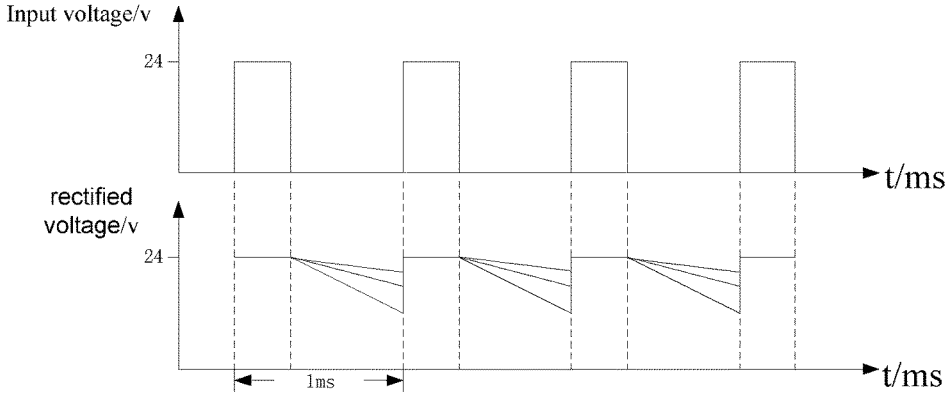
Figure 5:
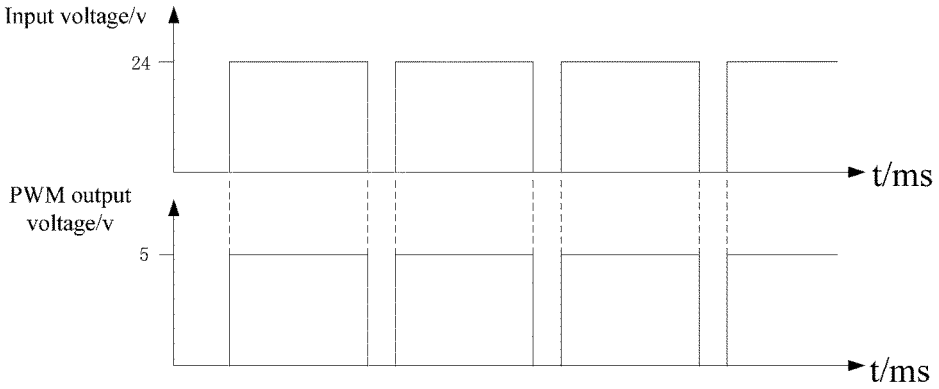
Figure 6:
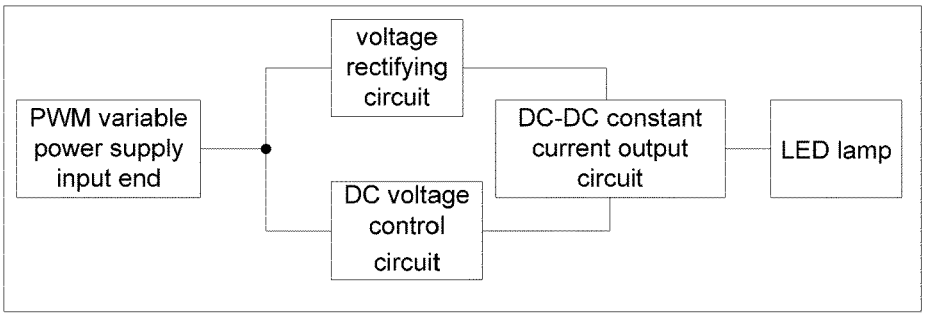
Figure 7:
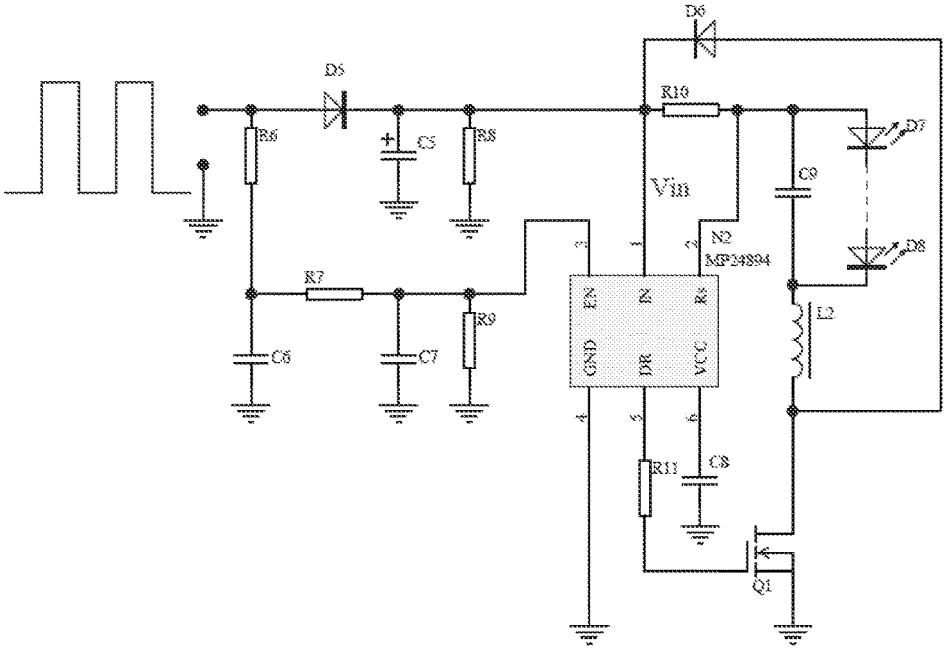
Figure 8A:
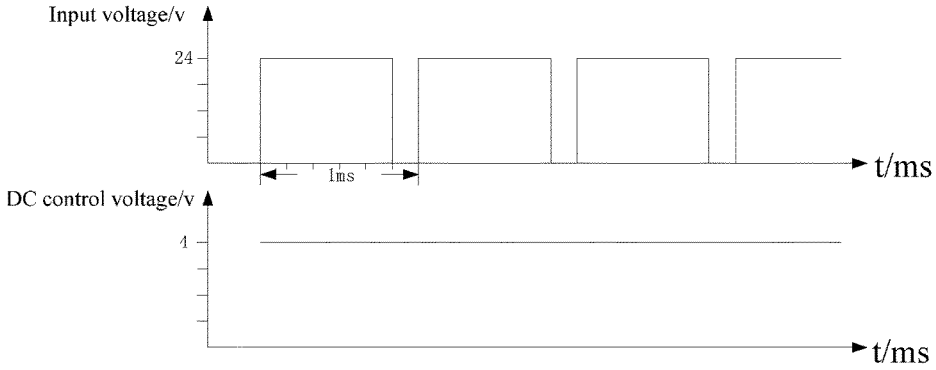
Figure 8B:
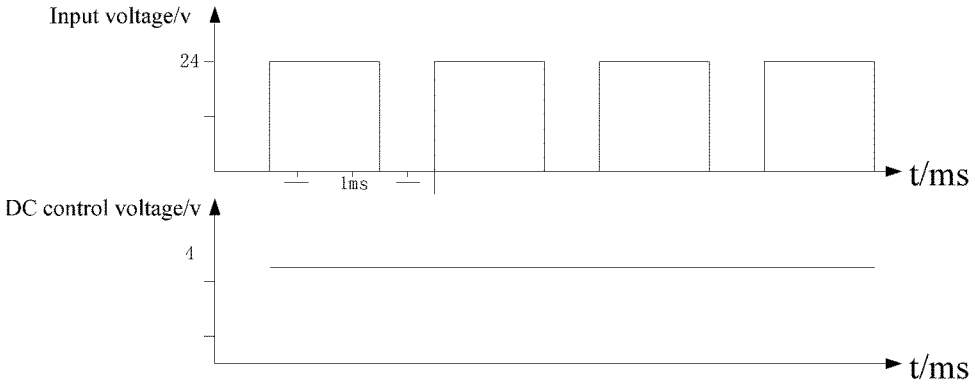
Figure 8C:
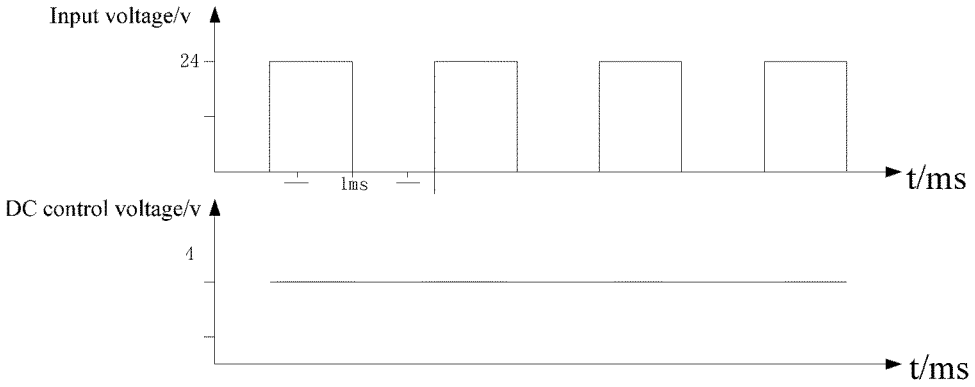
Figure 8D:
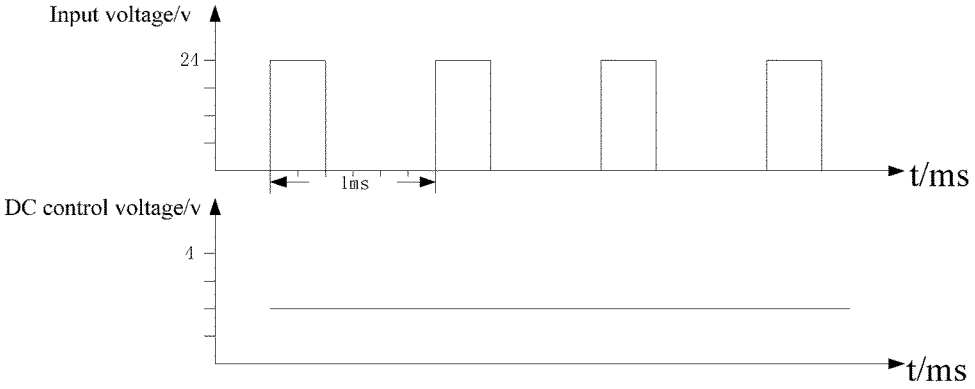

FIG. 3(*a*) to FIG. 3(*d*) are schematic diagrams showing changes in the voltage of the voltage rectifying circuit of the present invention according to a change in the duty ratio of the voltage at the PWM variable power supply input end;

FIG. 4 is a schematic diagram of a variation of an electrolytic capacitor ripple voltage in the case where the output voltage duty ratio is the same according to the present invention;

FIG. 5 is a schematic diagram showing voltage changes of a PWM matching circuit of the present invention;

FIG. 6 is a schematic diagram of the principle of another LED lamp of the present invention;

FIG. 7 is a schematic diagram of a circuit structure of another LED lamp of the present invention;

FIG. 8(*a*) to FIG. 8(*d*) are schematic diagrams showing changes in the voltage of the DC voltage control circuit of the present invention according to a change in the duty ratio of the voltage at the PWM variable power supply input end.

DESCRIPTION OF THE PREFERRED EMBODIMENTS

The present application is illustrated by way of the following detailed description based on of the accompanying drawings. It should be noted that illustration to the embodiment in this application is not intended to limit the invention.

Figure 1:
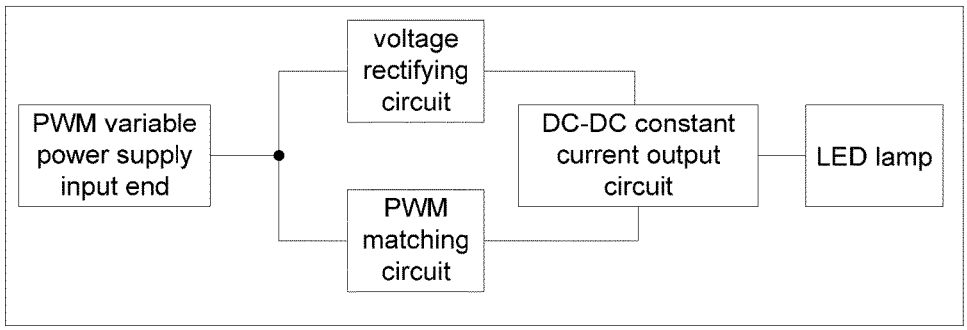
FIG. 1 is a principle schematic diagram of an LED lamp with constant current dimming drive circuit based on PWM input according to the present invention.

Referring to FIG. 1, the invention provides an LED lamp with constant current dimming drive circuit based on PWM input, which includes a PWM variable power supply input end, a PWM matching circuit, a voltage rectifying circuit, a DC-DC constant current output circuit, and an LED lamp. The voltage signal of the PWM variable power supply input end is provided by a PWM voltage output power supply, and the PWM variable power supply input end is respectively connected to the PWM matching circuit and the voltage rectifying circuit, and the PWM matching circuit is connected to the enable end of the DC-DC constant current output circuit, and the voltage rectifying circuit is connected to the power supply end of the DC-DC constant current output circuit for supplying power to the DC-DC constant current output circuit, the voltage of the voltage rectifying circuit changes in accordance with a duty cycle change of a voltage of the PWM variable power supply input end, the PWM matching circuit includes at least two voltage dividing resistors, and a voltage of the PWM variable power supply input end passes through the voltage dividing resistor of the PWM matching circuit outputs a PWM control signal, and the PWM control signal realizes a stroboscopic-free LED lamp through the DC-DC constant current output circuit.

Figure 2:
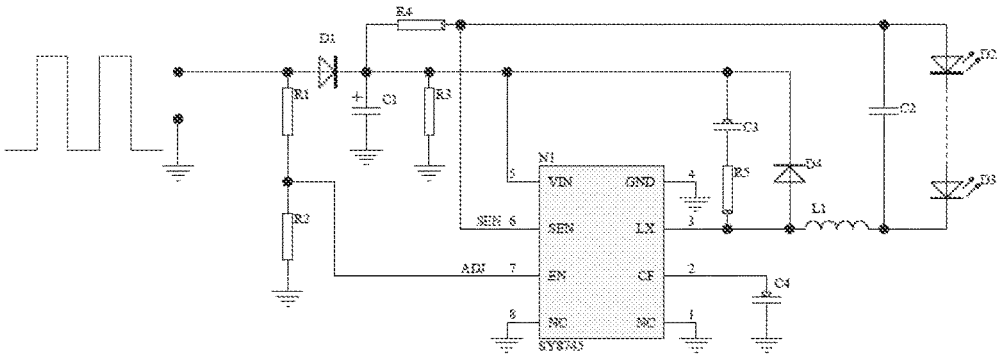
FIG. 2 is a schematic diagram showing the circuit structure of an LED lamp with constant current dimming drive circuit based on PWM input according to the present invention.
Figure 3A:
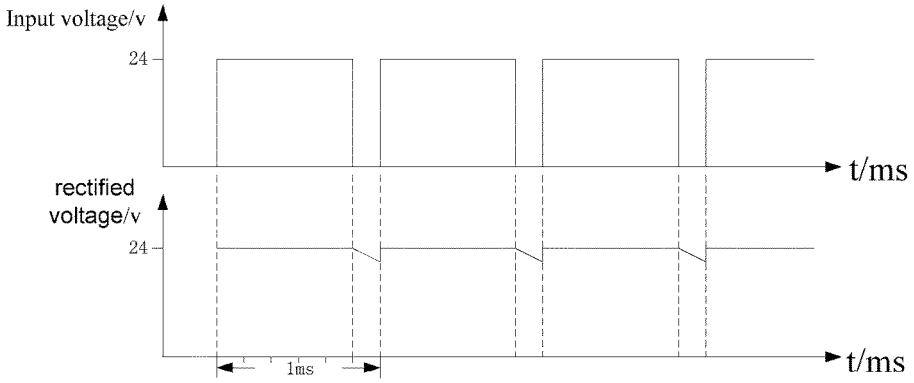
Figure 3B:
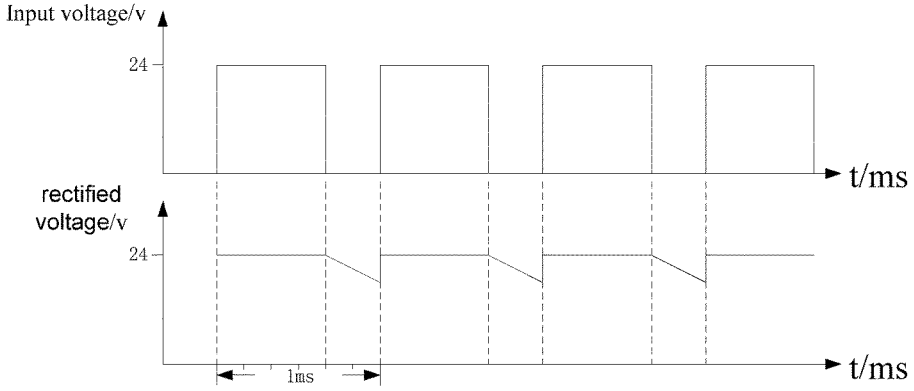
Figure 3C:
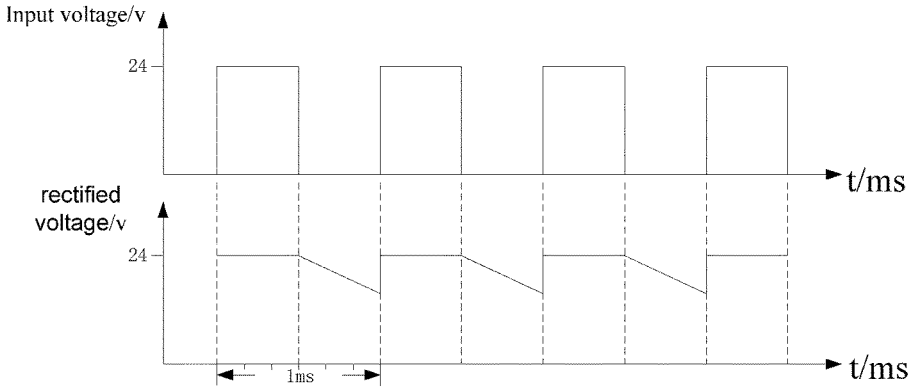
Figure 3D:
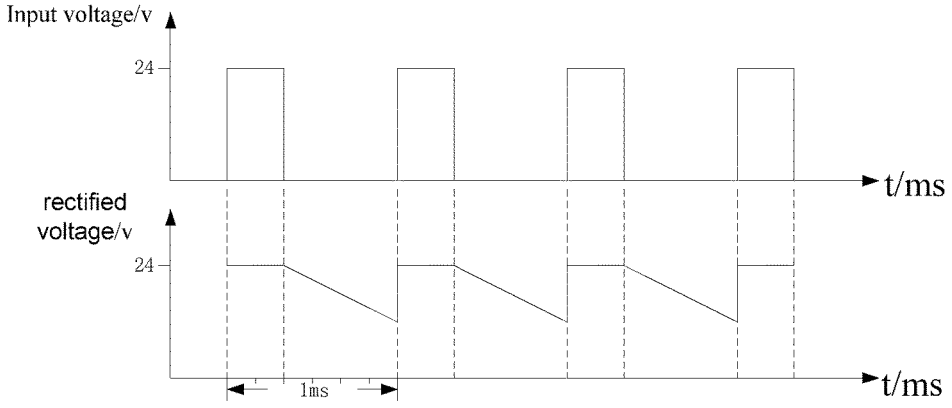

Referring to FIG. 1 and FIG. 2, the voltage signal of the PWM variable power supply input end is provided by the PWM voltage output power supply. It should be understood by those skilled in the art that the PWM voltage output power supply output PWM variable voltage signal, which can be implemented in various ways. The present invention is not described in detail, and those skilled in the art can implement the PWM variable voltage according to actual needs. The present invention does not impose any limitation, and the PWM voltage output power supply can choose the size and frequency of output PWM voltage according to actual needs. The voltage signal of the PWM variable power supply input end is divided into two ways: one is to filter the voltage signal of the PWM variable power supply input end into a pulsating DC voltage through a voltage rectifying circuit, and supply the DC-DC constant current output circuit to work; the other is to be divided by the voltage dividing resistor of the PWM matching circuit and then transmitted to the enable end of the DC-DC constant current output circuit to realize the adjustment of the LED lamp. Of course, the LED lamp mentioned in the present application can also be used as a normal lamp, that is, a constant voltage input without a PWM voltage signal.

Referring to FIG. 2, the voltage rectifying circuit includes a resistor R3, an electrolytic capacitor C1, and a diode D1. The anode of the diode D1 is connected to the PWM variable power supply input end, and the resistor R3 is connected in parallel with the electrolytic capacitor C1. The cathode of the diode D1 is connected to the power supply end of the DC-DC constant current output circuit and the anode of the electrolytic capacitor C1, and the cathode of the electrolytic capacitor is grounded.

In the voltage rectifying circuit, the diode D1 is used for isolating the electrolytic capacitor C1 and the PWM variable power supply input end. When the voltage value of the PWM variable power supply input end is greater than the electrolytic voltage of the electrolytic capacitor C1, the diode D1 is turned on and charged to the electrolytic capacitor C1, and simultaneously supplies power to the DC-DC constant current output circuit; when the voltage value of the PWM variable power supply input end is lower than the electrolytic voltage of the electrolytic capacitor C1, the diode D1 is turned off, and the electrolytic capacitor C1 supplies power to the DC-DC constant current output circuit.

Referring to FIG. 2 again, the DC-DC constant current output circuit of the LED lamp of the present invention adopts the SY8745 chip. Of course, in order to implement the LED lamp with constant current dimming drive circuit based on PWM input of the present application, the application further includes some necessary peripheral circuits that are well known to those skilled in the art and will not be described herein.

FIG. 3(*a*) to FIG. 3(*d*) are diagrams showing changes in the voltage of the voltage rectifying circuit of the present invention and the duty ratio of the voltage of the PWM variable power supply input end; in FIG. 3(*a*) and FIG. 3(*d*) It can be seen that the voltage of the voltage rectifying circuit changes according to the duty cycle of the voltage at the PWM variable power supply input end. When the capacity of the electrolytic capacitor is the same, the voltage duty ratio of the PWM variable power supply input end is larger, and the ripple voltage of the electrolytic capacitor of the voltage rectifying circuit is smaller, and vice versa. In the specific embodiment of the present application, assuming that the voltage of the PWM variable power supply input end is 24V, compared with FIG. 3(*a*)-FIG. 3(*d*), the ripple voltage of FIG. 3(*a*) is the smallest, and the ripple voltage of FIG. 3(*a*) is the largest. It should be understood by those skilled in the art that the capacity of the electrolytic capacitor C1 is set according to the load of the LED lamp, so that the ripple on the electrolytic capacitor C1 is sufficiently small. The resistor R3 is a dummy load and the resistance value is set as needed.

Referring to FIG. 4, when the voltage duty ratio of the PWM variable power supply input end is the same, when the capacity of the electrolytic capacitor is different, the ripple voltage of the voltage rectifying circuit is different, and when the capacity of the electrolytic capacitor is larger, the ripple voltage of the voltage rectifying circuit is the lower, and vice versa. In a specific embodiment of the present invention, as shown in FIG. 4, it is assumed that the voltage of the PWM variable power supply input end is 24V, and when the duty ratio is constant, the output voltage frequency is 1 KHz, and the output cycle time t is 1 ms, in one cycle time, three curves indicate the magnitude of the ripple voltage corresponding to the capacity of different electrolytic capacitors. In a specific embodiment of the present application, the frequency of the output voltage may be set to 10 KHz or the like as needed by those skilled in the art.

Referring to FIG. 2 and FIG. 5, the voltage dividing resistor R1 and the voltage dividing resistor R2 are set a reasonable ratio according to the input voltage of the PWM matching circuit to match the voltage input of the enable end of the DC-DC constant current output circuit, so as to drive the DC-DC constant current output circuit to control, realizes no stroboscopic adjustment of LED light. Among them, those skilled in the art need to understand that the output voltage of the PWM matching circuit is proportional to the voltage of the PWM variable power supply input end. In a specific embodiment of the present invention, when the voltage of the PWM variable power supply input end is 24V, the output voltage of the PWM matching circuit is 5V, which can ensure to drive the DC-DC constant current output circuit. In practical applications, those skilled in the art can change the voltage dividing resistor as needed to enable the DC-DC constant current output circuit to operate normally.

Referring to FIG. 6, an LED lamp with constant current dimming drive circuit based on PWM input includes a PWM variable power supply input end, a DC voltage control circuit, a voltage rectifying circuit, a DC-DC constant current output circuit, and an LED lamp, wherein a voltage signal of the PWM variable power supply input end is provided by a PWM voltage output power supply, and the PWM variable power supply input end is respectively connected to the DC voltage control circuit and the voltage rectifying circuit, and the DC voltage control circuit is connected to an enable end of the DC-DC constant current output circuit, and the voltage rectifying circuit is connected to a power supply end of the DC-DC constant current output circuit for supplying power to the DC-DC constant current output circuit. The voltage of the voltage rectifying circuit changes in accordance with a duty cycle of a voltage of the PWM variable power supply input end, the DC voltage control circuit includes at least two voltage dividing resistors and at least two capacitors, The voltage of the PWM variable power supply input end outputs a DC voltage control signal through the DC voltage control circuit, and the DC voltage control signal realizes the non-stroboscopic adjustment of LED lamp through the DC-DC constant current output circuit.

It should be understood by those skilled in the art that the structure and principle of the voltage rectifying circuit of another LED lamp of FIG. 7 of the present application are consistent with the voltage rectifying circuit of FIG. 1, and are not repeated here.

Referring to FIG. 7, the DC voltage control circuit of the present application includes a voltage dividing resistor R6, a voltage dividing resistor R7, a voltage dividing resistor R9, a capacitor C6, and a capacitor C7, wherein one end of the voltage dividing resistor R6 is connected to the PWM variable power supply input end, the other end of the voltage dividing resistor R6 is connected to one end of the capacitor C6 and the voltage dividing resistor R7, the other end of the capacitor C6 is grounded, and the other end of the voltage dividing resistor R7 is respectively connected to the enable end of the DC-DC constant current output circuit and one end of the capacitor C7 and the voltage dividing resistor R9, the other end of the capacitor C7 is grounded, and the other end of the voltage dividing resistor R9 is grounded. The voltage dividing resistor R6, the voltage dividing resistor R7, the voltage dividing resistor R9, the capacitor C6, and the capacitor C7 form an average value filter. In practical use, the filter is both a filter and a voltage divider, and the level is designed to meet the requirements of the enable end of the DC-DC constant current output circuit.

Referring to FIG. 7 again, the DC-DC constant current output circuit of the LED lamp of the present invention adopt the MP24894 chip. Of course, in order to implement the LED lamp with constant current dimming drive circuit based on PWM input of the present application, the application further includes some necessary peripheral circuits which are well known to those skilled in the art and will not be described herein.

Referring to FIG. 8, the voltage of the DC voltage control circuit is determined according to the duty ratio of the voltage of the PWM variable power supply input end. When the duty cycle of the PWM voltage of the PWM variable power supply input end is larger, the voltage of the DC voltage control circuit is larger, and vice versa. In a specific embodiment of the present application, the voltage of the PWM variable power supply input end is set to be 24V. In a specific embodiment of the present application, the frequency of the output voltage is set to be 1 kHz, and the cycle time t of the output is 1 ms. In a specific embodiment of the present application, the frequency of the output voltage may be set to be 10 KHz or the like as needed by those skilled in the art.

Assuming that the duty cycle of the voltage signal of the PWM variable power supply input end is 5/6, the voltage of the DC voltage control circuit is 4V; when the duty ratio of the high-level voltage signal of the PWM voltage of the PWM variable power supply input end is 2/3, the voltage of the DC voltage control circuit is 3.5V; when the duty ratio of the high-level voltage signal of the PWM voltage of the PWM variable power supply input end is 1/2, the voltage of the DC voltage control circuit is 3V; When the duty ratio of the high-level voltage signal of the PWM voltage of the PWM variable power supply input end is 1/3, the voltage of the DC voltage control circuit is 2V, and the voltage of the DC voltage control circuit can satisfy the voltage requirement of the enable end of the DC-DC constant current output circuit. In a specific practical design, a person skilled in the art can design an average value filter composed of a voltage dividing resistor R4, a voltage dividing resistor R5, a voltage dividing resistor R6, and a capacitor C2 and a capacitor C3 according to specific needs.

Compared with the prior art, the driving circuit of the invention makes the LED lamp suitable for large-area installation, convenient installation, high reliability, and simple and convenient control. The lamp current of the LED lamp of the invention is proportional to the duty ratio of the PWM, which facilitates the parallel connection of large quantities of such lamps, has good dimming brightness consistency, and has small dimming deviation between the LED lamps.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. An LED lamp with constant current dimming drive circuit based on PWM input, comprising a PWM variable power supply input end, a PWM matching circuit, a voltage rectifying circuit, a DC-DC constant current output circuit, and an LED lamp, wherein the voltage signal of the PWM variable power supply input end is provided by a PWM voltage output power supply, and the PWM variable power supply input end is respectively connected to the PWM matching circuit and the voltage rectifying circuit, the PWM matching circuit is connected to the enable end of the DC-DC constant current output circuit, and the voltage rectifying circuit is connected to the power supply end of the DC-DC constant current output circuit for supplying power to the DC-DC constant current output circuit, wherein the voltage of the voltage rectifying circuit changes in accordance with a duty cycle of a voltage of the PWM variable power supply input end, the PWM matching circuit including at least two voltage dividing resistors, and a voltage of the PWM variable power supply input is divided by the voltage dividing resistor of PWM matching circuit; wherein the PWM matching circuit outputs a PWM control signal, and the PWM control signal provides a non-stroboscopic adjustment to the LED lamp through the DC-DC constant current output circuit.

2. The LED lamp with constant current dimming drive circuit based on PWM input as claimed in claim 1, wherein the voltage rectifying circuit includes a resistor (R3), an electrolytic capacitor (C1), and a diode (D1), the anode of the diode (D1) is connected to the PWM variable power supply input end, and the resistor (R3) is connected in parallel with the electrolytic capacitor (C1), the cathode of the diode (D1) is connected to the power supply end of the DC-DC constant current output circuit and the anode of the electrolytic capacitor (C1), and the cathode of the electrolytic capacitor is grounded.

3. The LED lamp with constant current dimming drive circuit based on PWM input as claimed in claim 2, wherein the diode (D1) is used for isolating the electrolytic capacitor (C1) and the PWM variable power supply input end, when the voltage value of the PWM variable power supply input end is greater than the electrolytic voltage of the electrolytic capacitor (C1), the diode (D1) is turned on and charges the electrolytic capacitor (C1), and simultaneously supplies power to the DC-DC constant current output circuit; when the voltage value of the PWM variable power supply input end is lower than the electrolytic voltage of the electrolytic capacitor (C1), the diode (D1) is turned off, and the electrolytic capacitor (C1) supplies power to the DC-DC constant current output circuit.

4. The LED lamp with constant current dimming drive circuit based on PWM input as claimed in claim 1, wherein the PWM matching circuit includes a voltage dividing resistor (R1) and a voltage dividing resistor (R2), one end of the voltage dividing resistor (R1) is connected to the PWM variable power supply input end, and the other end of the voltage dividing resistor (R1) is respectively connected to the enable end of the DC-DC constant current output circuit and one end of the voltage dividing resistor (R2), and the other end of the voltage dividing resistor (R2) is grounded.

5. An LED lamp with constant current dimming drive circuit based on PWM input, comprising a PWM variable power supply input end, a DC voltage control circuit, a voltage rectifying circuit, a DC-DC constant current output circuit, and an LED lamp, wherein the voltage signal of the PWM variable power supply input end is provided by a PWM voltage output power supply, and the PWM variable power supply input end is respectively connected to the DC voltage control circuit and the voltage rectifying circuit, and the DC voltage control circuit is connected to the enable end of the DC-DC constant current output circuit, and the voltage rectifying circuit is connected to the power supply end of the DC-DC constant current output circuit for supplying power to the DC-DC constant current output circuit, the voltage of the voltage rectifying circuit changes in accordance with a change in duty cycle of the voltage at the PWM variable power supply input end, the DC voltage control circuit comprising at least two voltage dividing resistors and at least two capacitors, the voltage of the PWM variable power supply input end outputs a DC voltage control signal through the DC voltage control circuit, and the DC voltage control signal provides a non-stroboscopic adjustment to the LED lamp through the DC-DC constant current output circuit.

6. The LED lamp with constant current dimming drive circuit based on PWM input as claimed in claim 5, wherein the voltage rectifying circuit includes a resistor (R8), an electrolytic capacitor (C5), and a diode (D5), the anode of the diode (D5) is connected to the PWM variable power supply input end, and the resistor (R8) is connected in parallel with the electrolytic capacitor (C5), the cathode of the diode (D5) is connected to the power supply end of the DC-DC constant current output circuit and the anode of the electrolytic capacitor (C5), and the cathode of the electrolytic capacitor is grounded.

7. The LED lamp with constant current dimming drive circuit based on PWM input as claimed in claim 6, wherein the diode (D5) is used for isolating the electrolytic capacitor (C5) and the PWM variable power supply input end, when the voltage value of the PWM variable power supply input end is greater than the electrolytic voltage of the electrolytic capacitor (C5), the diode (D5) is turned on and charged to the electrolytic capacitor (C5), and simultaneously supplying power to the DC-DC constant current output circuit; when the voltage value of the PWM variable power supply input end is lower than the electrolytic voltage of the electrolytic capacitor (C5), the diode (D5) is turned off, and the electrolytic capacitor (C5) supplies power to the DC-DC constant current output circuit.

8. The LED lamp with constant current dimming drive circuit based on PWM input as claimed in claim 5, wherein the DC voltage control circuit includes a voltage dividing resistor (R6), a voltage dividing resistor (R7), a voltage dividing resistor (R9), a capacitor (C6), and a capacitor (C7), one end of the voltage dividing resistor (R6) is connected to the PWM variable power supply input end, and the other end of the voltage dividing resistor (R6) is connected to one end of the capacitor (C6) and the voltage dividing resistor (R7), and the other end of the capacitor (C6) is grounded, the other end of the voltage dividing resistor (R7) is respectively connected to the enable end of the DC-DC constant current output circuit and the capacitor (C7), one end of the voltage dividing resistor (R9), the other end of the capacitor (C7) is grounded, and the other end of the voltage dividing resistor (R9) is grounded.

* * * * *